US010117502B2

(12) United States Patent
Ward

(10) Patent No.: US 10,117,502 B2
(45) Date of Patent: Nov. 6, 2018

(54) PORTABLE CONTAINER

(71) Applicant: Kevin James Ward, Loganville, GA (US)

(72) Inventor: Kevin James Ward, Loganville, GA (US)

( * ) Notice: Subject to any disclaimer, the term of this patent is extended or adjusted under 35 U.S.C. 154(b) by 55 days.

(21) Appl. No.: 15/460,177

(22) Filed: Mar. 15, 2017

(65) Prior Publication Data

US 2018/0263363 A1 Sep. 20, 2018

(51) Int. Cl.

| | |
|---|---|
| ***A45F 3/04*** | (2006.01) |
| ***A45F 3/08*** | (2006.01) |
| ***A62B 25/00*** | (2006.01) |
| *A45F 3/00* | (2006.01) |

(52) U.S. Cl.

CPC ..... *A45F 3/04* (2013.01); *A62B 25/00* (2013.01); *A45F 3/08* (2013.01); *A45F 2003/001* (2013.01)

(58) Field of Classification Search

CPC ..... A45F 3/04; A45F 3/08

USPC ..... 224/627–659

See application file for complete search history.

(56) References Cited

U.S. PATENT DOCUMENTS

| | | | |
|---|---|---|---|
| 5,341,973 | A | 8/1994 | Dawes et al. |
| 5,579,966 | A | 12/1996 | Krumweide et al. |
| 2006/0102675 | A1 | 5/2006 | Bezak et al. |

*Primary Examiner* — Justin Larson

(57) ABSTRACT

A portable container comprising a bag configured with at least one external strap, a cover, structural panels on at least one of a back, sides and bottom of said bag, pockets attached to various panels of said bag, and at least one connection point attached to said bag. Said bag is configured with two straps. Said straps are configured to attach externally to a back of a user. Said at least one strap is configured to fit over a shoulder of said user. Said bag is configured to be operable as a backpack. Said at least one connection point is configured as an attachment means comprising at least one of a D ring, a carabiner, a loop, a hook and a clip configured for attachment to said bag. Said at least one attachment means is configured for attachment of items not held inside said bag.

11 Claims, 7 Drawing Sheets

PORTABLE CONTAINER

CROSS-REFERENCE TO RELATED APPLICATIONS

Not applicable.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to baggage. More particularly, certain embodiments of the invention relate to a bag that can be used to carry personal gear such as, but not limited to, firefighting gear.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. Often, seconds matter in firefighting, and many firefighters may attempt to reduce the amount of time needed to put on their gear. Firefighting gear may include, without limitation, turnout gear (e.g., jackets, pants, and jumpsuits), helmets, boots, gloves, hoods, respirators, visors, eye protection, and ear protection. It is believed that maintaining this gear in an organized manner may help firefighters get ready quickly. In addition, some firefighters may store their gear in a bag so that the gear may be transported from place to place.

By way of educational background, an aspect of the related technology generally useful to be aware of is that there are some bags available for carrying firefighting gear. Some of these bags may be carried with a single shoulder strap or hand straps. Other bags may be implemented as backpacks. Some such approaches may be designed to include fire shelters, which are usually specific to wildland firefighting.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a front perspective view of the bag, and FIG. 1B is a rear perspective view of the bag;

FIG. 3A is a front perspective view of the bag in an open configuration, and FIG. 3B is a front perspective view of the bag in a closed position.

Figure 1A:
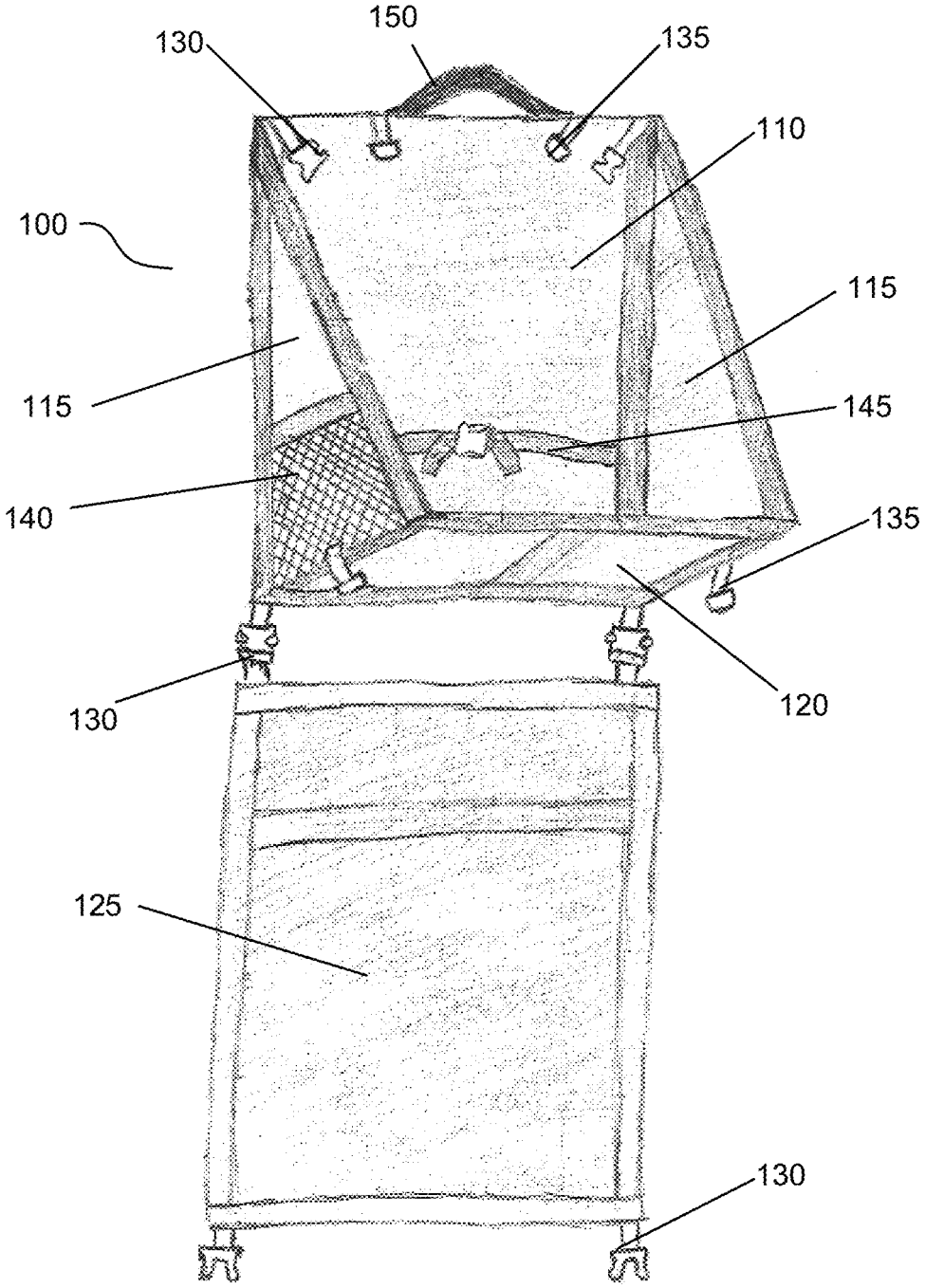
FIGS. 1A and 1B illustrate an exemplary bag that can be used to carry personal gear, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently, the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognized in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031

("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to avoid a strict numerical boundary to the specified parameter," see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction with, some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the presently disclosed and claimed subject matter may include the use of either of the other two terms. Thus, in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide a bag that can be used to carry personal gear such as, but not limited to, firefighting gear. One embodiment may be implemented as a backpack that can be used to carry structural firefighting gear. This embodiment may be used to transport such gear and also can be used to organize structural firefighting gear when stored inside a fire station or other location. Some embodiments may be used to help with storing and moving various types of gear such as, but not limited to, structural firefighting personal protective bunker gear, structural turnout gear, and personal protection equipment.

Figure 1B:
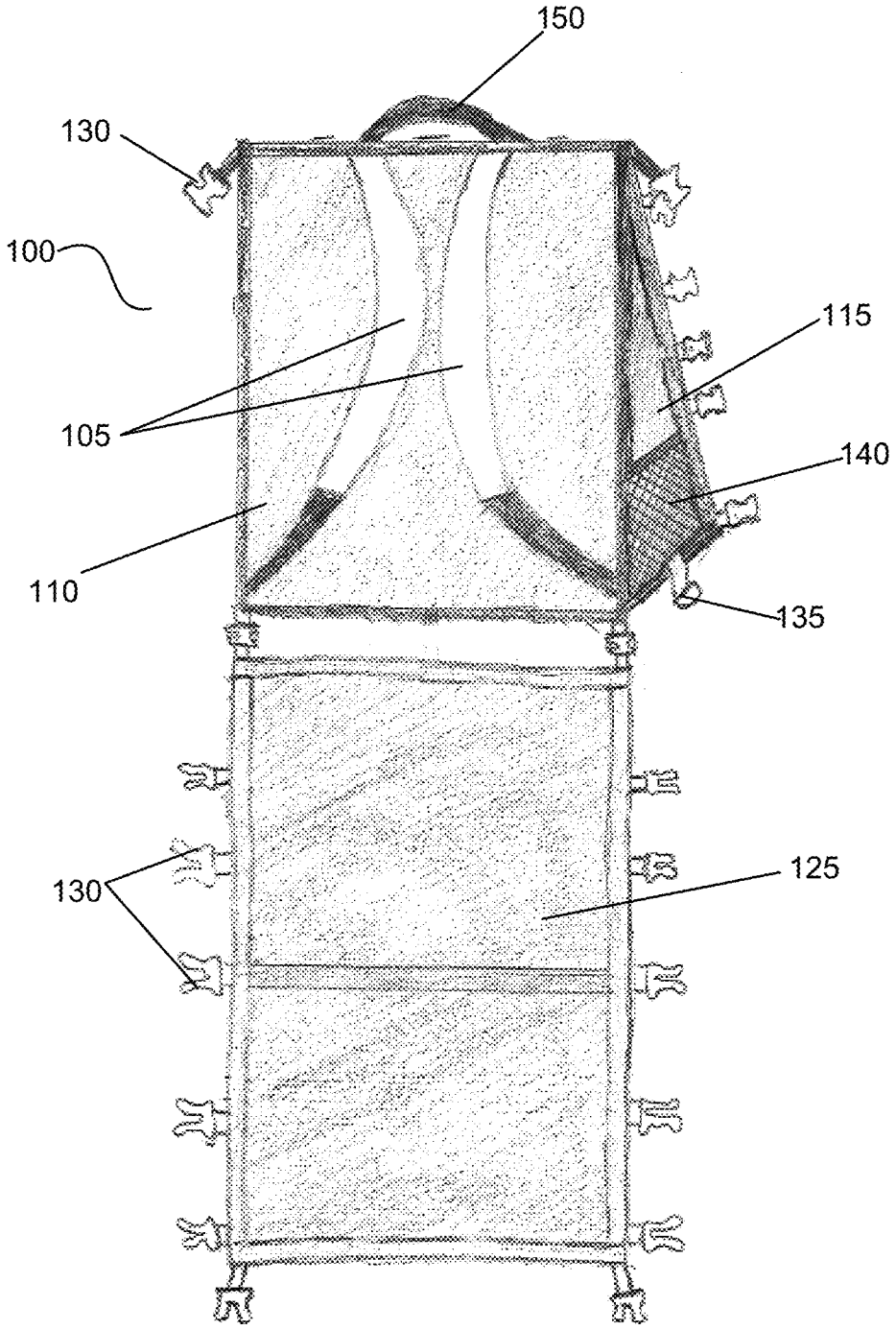

FIGS. 1A and 1B illustrate an exemplary bag 100 that may be used to carry personal gear, in accordance with an embodiment of the present disclosure. FIG. 1A is a front perspective view of bag 100, and FIG. 1B is a rear perspective view of bag 100. In the present embodiment, bag 100 may be configured as a backpack with two shoulder straps 105 attached to a back panel 110 of bag 100 to allow a user to carry gear on both shoulders, which may disperse the weight of bag 100 evenly. Back panel 110 may be connected to two side panels 115 and a bottom panel 120 to create a compartment with an open front. Bottom panel 120 may be angled such that a free edge of bottom panel 120 may be slightly higher than an edge connected to back panel 110. This configuration may prevent items from sliding out of bag 100. A suitable angle for bottom panel 120 may be approximately 80 degrees. Bottom panel 120 may be angled to a greater or lesser degree, and in some embodiments, may not be angled upward. Angling between 60 to 90 degrees is practical. However, an angle of 80 degrees may be optimal to maintain contents level or slightly higher than level. If firefighting boots and pants are not strapped into the bag 100, these items may fall out of the bag 100 when the bag 100 is in an open configuration. In the present embodiment, a cover 125 may be attached to bag 100 to cover the open front and help hold gear in place within bag 100 when moved or stored.

Panels 110, 115, and 120 may be made out of durable and lightweight materials such as, but not limited to, light to heavy weight webbing made out nylon, polypro, and cotton, light to heavy duty nylon and cotton canvas materials, PVC, leather, Nylon, polyester, Cordura, and materials that are classified as a light to heavy duty grade. These materials may be typically sufficiently sturdy to provide some structure to bag 100 and support gear within. Some embodiments may incorporate an interface or an insert made of a solid piece of material such as, but not limited to, plastic or cardboard between layers of softer materials to stiffen the panels. Such interfaces or inserts may be placed in one or more of the panels. Alternate embodiments may comprise frames around the outer edges of the panels to help maintain the shape of the bag. Such frames may be made from a various suitable materials including, without limitation, plastic or metal. In the present embodiment, cover 125 may be made of a multiplicity of suitable materials including, without limitation, the same types of materials used to make panels 110, 115, and 120, mesh materials, stretchable materials, and a woven net of straps, as illustrated by way of example in FIGS. 3A and 3B. Cover 125 may be connected to bag 100 by fasteners 130. It is contemplated that various different types of attachment means may be used for fasteners 130 such as, but not limited to, side release buckles, D ring buckles, hooks, hook and loop material, snaps, buttons, zippers, Velcro or other adhesive material that comes apart when enough tension is applied. Fasteners 130 may be connected to bag 100 and cover 125 by straps that may be adjustable in length to accommodate varying amounts of gear in bag 100. In some embodiments, these straps may be elastic to provide adjustability. It is contemplated that fasteners 130 may be provided in a multiplicity of suitable quantities and configurations. For example, without limitation, referring to FIG. 1A, fasteners 130 may be provided at the bottom and top of bag 100 and cover 125 to enable the corners of cover 125 to be connected to bag 100. Referring to FIG. 1B, in some implementations fasteners 130 may also be placed along the sides of cover 125 and side panels 115 to enable the edges of cover 125 to connect to bag 100 along with the corners. In an embodiment, cover 125 may be completely detachable from bag 100. In some embodiments, the covers may not be detachable. For example, without limitation, in some such embodiments the cover 125 may be permanently attached to the bottom panel or the lower portion of the back panel with fasteners 130 on the opposite end of the cover 125 to attach to the upper portion of the bag 100. In embodiments, the width of cover 125 may match the width of bag 100, and the length of cover 125 may allow for cover 125 to reach past the top of bag 100 to accommodate bulky gear that may extend beyond one or more edges of panels 110, 115 and 120. The size of the cover 125 may be larger or smaller in some alternate embodiments. In an embodiment, the cover 125 may be in shapes other than rectangles such as, but not limited to, rounded, triangular or irregular shapes. Cover 125 may be manufactured and/or supplied separately from bag 100. This may allow cover 125 to be customized for an individual or a department.

At least one connection point 135 may be placed on bag 100 to which items may be attached such as, but not limited to, helmets, respirators, hangers for jackets, or hand tools. Those skilled in the art will readily recognize, in light of and in accordance with the teachings of the present invention, that various different types of attachment means may be used for connection points 135 including, but not limited to, D rings, carabiners, loops, hooks, or clips. In addition, pockets 140 may be located on the outside of side panels 115 to contain items such as, but not limited to gloves, tools, and other supplies. Some embodiments may also comprise pockets on the inside surfaces of panels 115 or 110 or cover 125. One such embodiment may comprise a cover 125 that has a front pocket into which a helmet and other items may be placed. Additional connection points or pockets may be placed on internal and/or external locations of the bag 100. A securing strap 145 may hold items down within bag 100. Such items may include, without limitation, boots and pants. Strap 145 may be adjustable and may comprise means for fastening and detaching strap 145 such as, but not limited to, a side release clip, a buckle, snaps, or hook and loop material. In some applications bag 100 may not comprise such a securing strap or may comprise one or more such securing straps in different locations. A loop 150 at the top of bag 100 may be used to carry bag 100 or to hang bag 100. Bag 100 can be attached or hung in a locker, on a wall, in a closet, on a coat rack, or elsewhere.

A user may be able to store and carry structural firefighting gear in bag 100 in a manner that allows the user to organize the gear. Having organized gear may enable a user to find a specific piece of gear within bag 100 more quickly and easily than otherwise, which may reduce the amount of time needed to put the gear on. Bag 100 may be designed to fit most if not all firefighting gear lockers. Exemplary dimensions for bag 100 to fit in a typical gear locker may be approximately 14 inches long by 15 inches wide by 22 inches tall. To fit a bag 100 of this size, cover 125 may be of approximate measurements 15 inches wide by 30 to 40 inches long. Those skilled in the art will readily recognize, in light of and in accordance with the teachings of the present invention that alternate embodiments may be made in a multiplicity of suitable sizes. Such sizes for bag 100 may include ranges of 12" to 20" in length, 14" to 18" in width, and 20" to 24" in height. These size ranges may be preferable based various sizes of firefighting coats, pants, and boots. Additional ranges for the cover 125 may be 14" to 18" wide and 30" to 45" in height. Depending on the size of the bag 100 needed, these ranges may preferable. If the bag 100 is used to carry or store gear outside of firefighting uses, bag 100 may be provided in various sizes, for example small, medium, and large. For a small size bag 100, the dimensions may range from 1" to 6" in length, 1" to 8" in width, and 1" to 12" in height. For a medium sized bag 100 the range may be from 6" to 14" in length, 6" to 14" in width, and 12" to 18" in height. For a large sized bag 100, the range may be from 10" to 22" in length, 10" to 20" in width, and 14" to 24" in height. Various items may be stored and carried in bag 100 including, without limitation, bunker gear or turnout gear, firefighters PPE (personal protection equipment), bunker coats, bunker pants, bunker boots, SCBA (self-contained breathing apparatus) masks, firefighting helmets, gloves, hoods, respirators, and tools. A user may also use bag 100 to move gear from fire station to fire station since straps 105 enable bag 100 to be carried over both shoulders while detachable cover 125 typically allows the gear to stay within bag 100. Shoulder straps 105 may hold bag securely on a user and help prevent free movement of bag 100. Also, since the weight of the gear may be supported evenly on the back and shoulders of the user, bag 100 may help prevent back, neck, or shoulder injuries to the user due to the weight of the gear. Moreover, bag 100 may be made of materials that can be cleaned as needed either by hand or in a washing machine. The materials and hardware used for bag 100 may typically be heavy duty due to weight and stress that may typically put on bag 100.

Figure 2A:
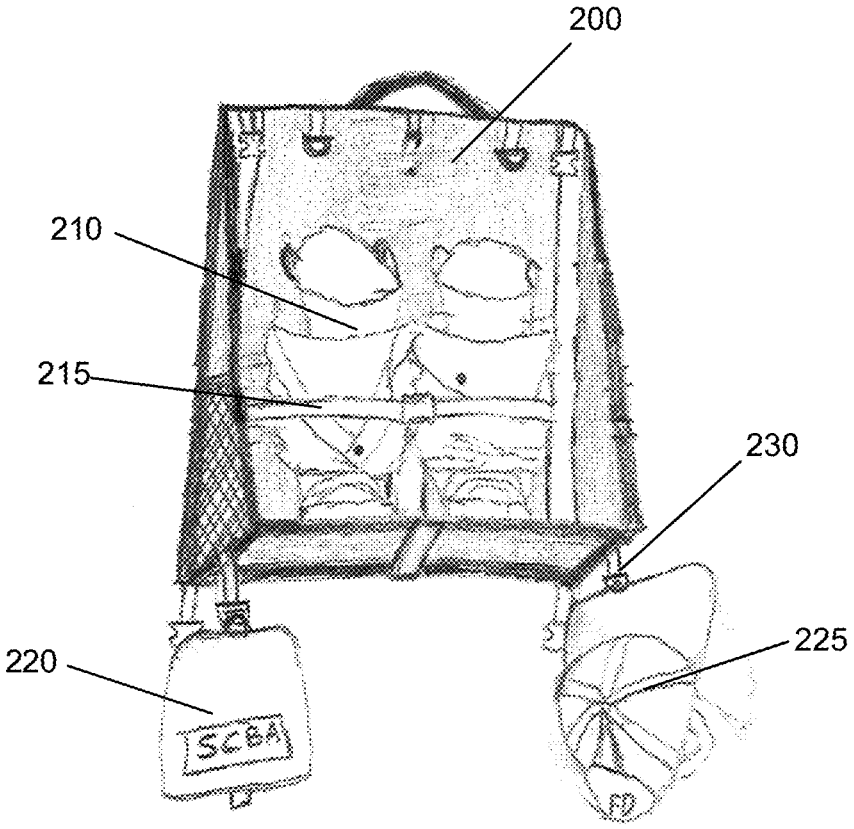
FIGS. 2A through 2E illustrate exemplary configurations in which a bag can be used to carry personal gear, in accordance with an embodiment of the present invention.
Figure 2B:
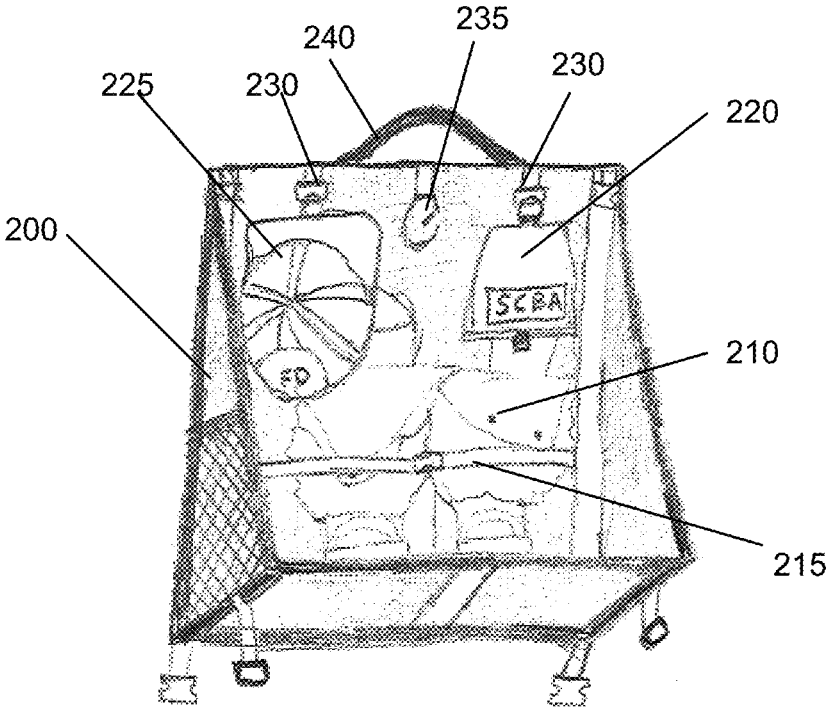
Figure 2C:
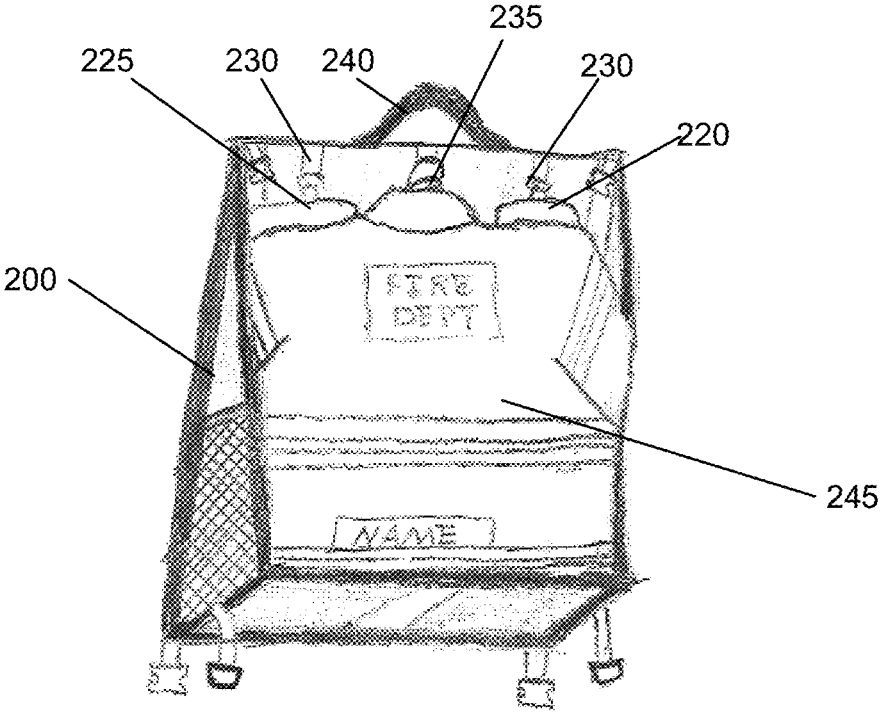
Figure 2D:
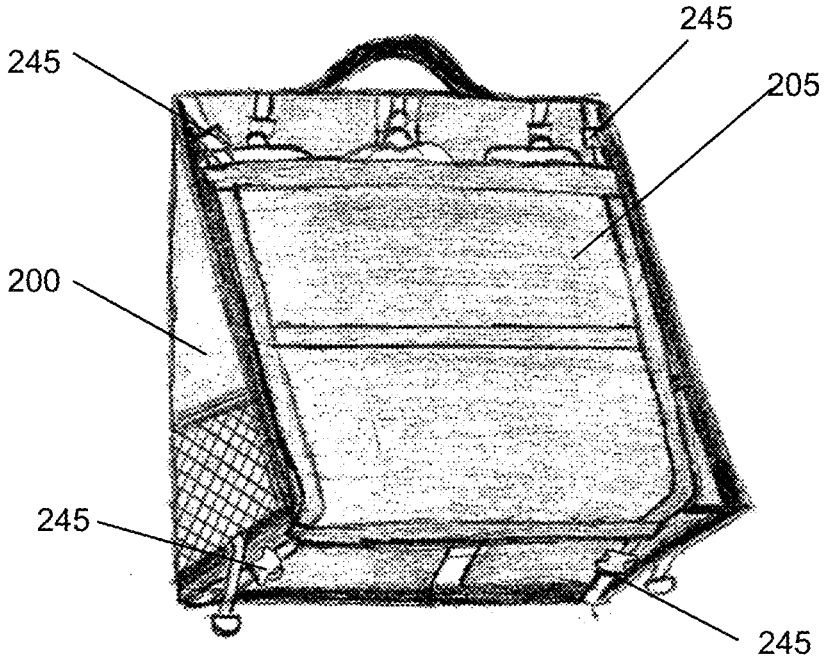
Figure 2E:
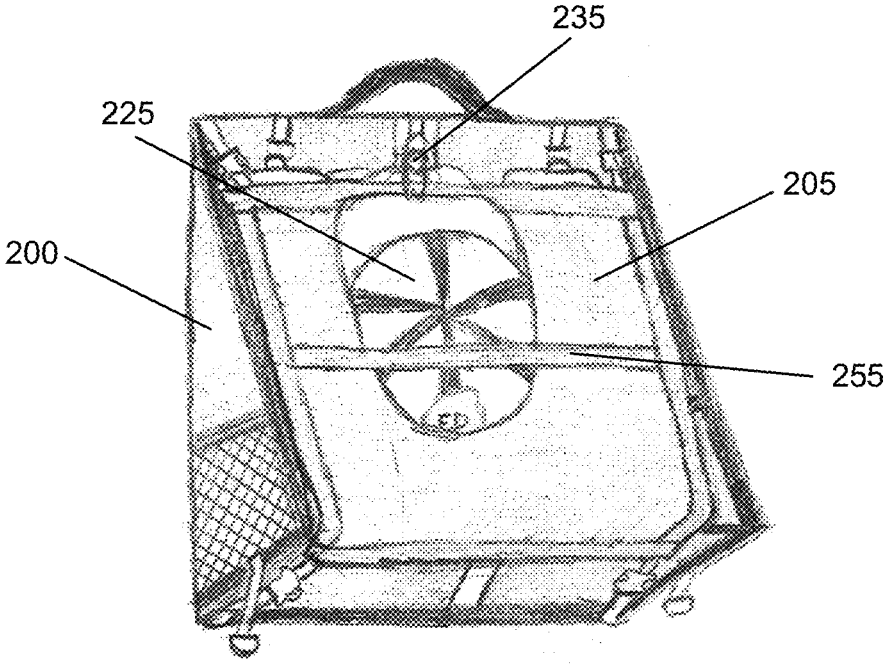

FIGS. 2A through 2E illustrate exemplary configurations in which a bag 200 can be used to carry items, in accordance with an embodiment of the present invention. In the present embodiment, bag 200 may be used to carry structural firefighting gear and also can be used to organize structural firefighting gear when stored inside a fire station or other location. Bag 200 can store the gear in an open position as shown by way of example in FIGS. 2A, 2B, and 2C or in a closed position with a cover flap 205 encapsulating the exposed gear as shown by way of example in FIGS. 2D and 2E. When in the open position, bag 200 may be hung in a locker or elsewhere to keep the gear organized and ready for use. Referring to FIG. 2A, a pair of boots 210 may be placed in the bottom of bag 200 and secured in place by a strap 215. In some applications, pants may also be secured within strap 215 along with boots 210. A SCBA mask 220 and a firefighting helmet 225 may be attached to connection points 230 on the bottom of bag 200. Referring to FIGS. 2B and 2C, in another configuration, boots 210 are secured to the bottom of bag 200 by strap 215 and SCBA mask 220 and helmet 225 are attached to connection points 230 at the top of bag 200 rather than the bottom of bag 200. Then, referring to FIG. 2C, a clip 235 just under a handle 240 at the top of bag 200 may be used to hang a firefighting coat 245. When in the closed position, bag 200 may be used to transport gear from place to place. Referring to FIG. 2D, bag 200 is shown with cover 205 attached to bag 200 at fasteners 250 at the bottom and top of bag 200. Referring to FIG. 2E, a helmet 225 is shown attached to clip 235 and stored on the outside of cover 205. A strap 255 may help secure helmet 225 to bag 200. It is contemplated that gear may be stored within bag 200 in various manners. For example, without limitation, helmet 225 may be stored in a pocket on the front of cover 205, or may be installed in the center of the inside, back panels 110, 200. Gear or equipment may also be stored in pockets that are attached in various locations of the cover, front and back, or may also be attached to and hang down from the sides, front, or back of the bottom panel to hold gear or equipment when the bag is being used in an open configuration.

Figure 3A:
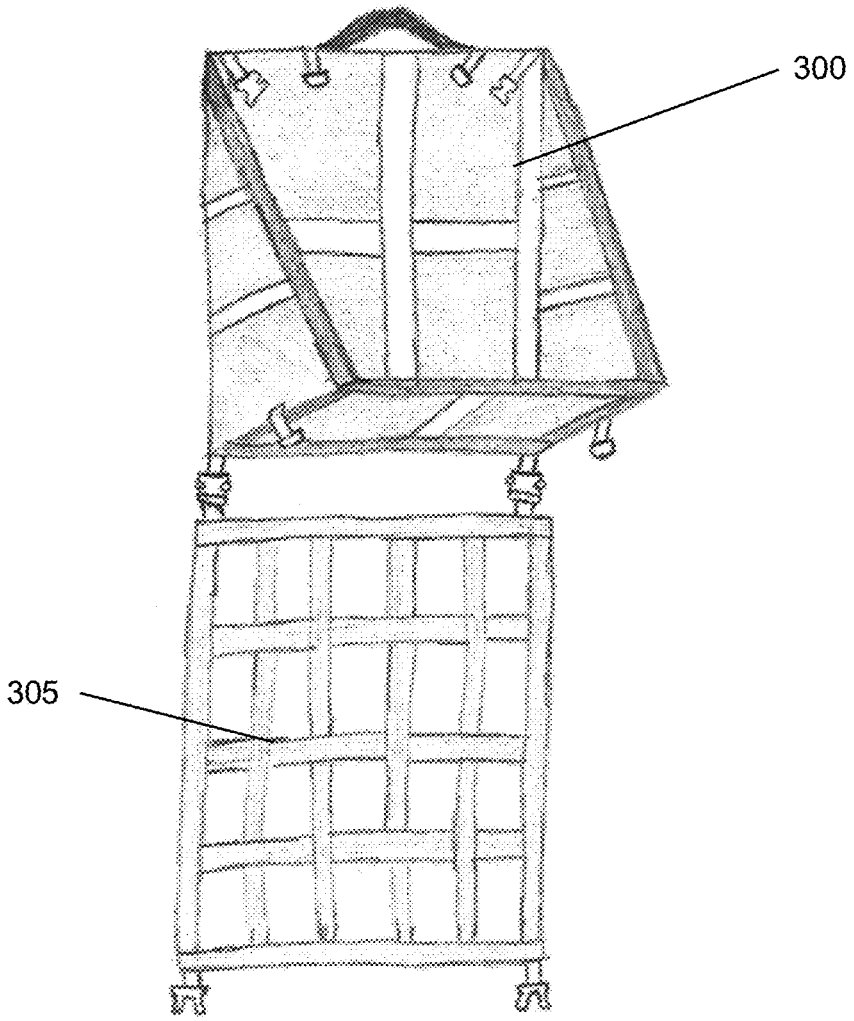
FIGS. 3A and 3B illustrate an exemplary bag that can be used to carry personal gear, in accordance with an embodiment of the present invention.
Figure 3B:
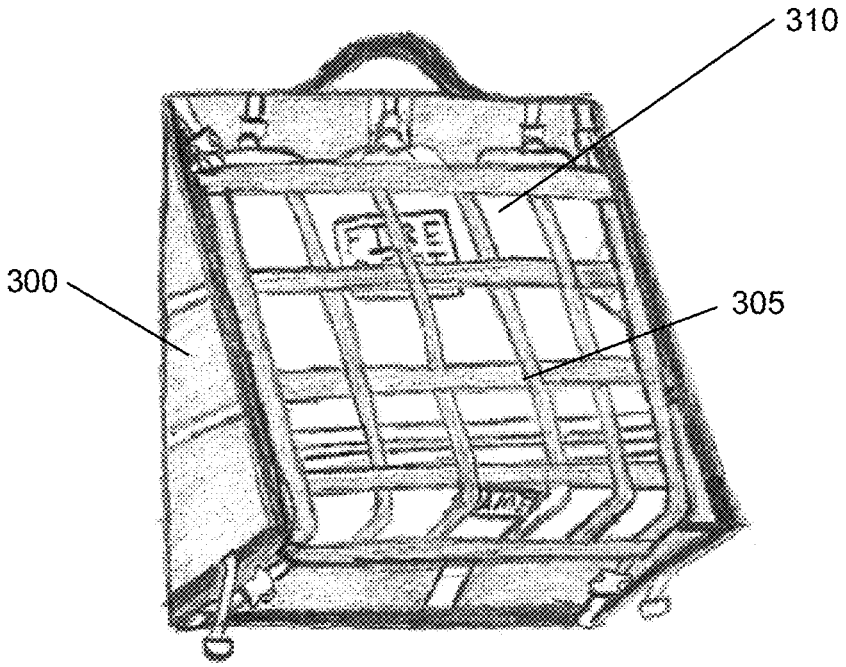

FIGS. 3A and 3B illustrate an exemplary bag 300 that can be used to carry items, in accordance with an embodiment of the present invention. FIG. 3A is a front perspective view of bag 300 in an open configuration, and FIG. 3B is a front perspective view of bag 300 in a closed position. In the present embodiment, a cover 305 is implemented as a rectangular netting made out of webbing rather than a solid piece of material. Referring to FIG. 3B, cover 305 may be attached to bag 300 to hold gear 310 within bag 300 when moving gear 310 from one location to another.

Those skilled in the art will readily recognize, in light of and in accordance with the teachings of the present invention, that some embodiments may comprise various additional and alternative features. For example, without limitation, one embodiment may be implemented as a backpack with an open concept where gear is attached directly to the backpack and tightened down with horizontal and/or vertical tie down straps or webbing-like material. This embodiment may or may not comprise a cover. In other embodiments, bag 100 may comprise one strap that crosses over the chest from one shoulder to the opposite side lower chest. In yet other embodiments, bag 100 may close completely. Closing means such as, but not limited to, zippers or hook and loop material may be used to close bag 100 completely. Other suitable features that may be included on some embodiments may include, without limitation, lights, reflective materials, waist straps for additional support when wearing the bag 100, or pockets sized and shaped for specific items.

Attachment points 135 shown in FIG. 1A and attachment points 230 and 235 in FIGS. 2B and 2C may vary in location. For example, one central attachment point with three extended attachments may be used to attach gear, for example helmet, mask, and/or coat.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a bag 100 that can be used to carry personal gear according to the present invention will be apparent to those skilled in the art. Various aspects of the invention have been described above by way of illustration, and the specific embodiments disclosed are not intended to limit the invention to the particular forms disclosed. The particular implementation of the bag 100 may vary depending upon the particular context or application. By way of example, and not limitation, the bag 100 described in the foregoing may principally be directed to firefighting implementations; however, similar techniques may instead be applied to other types of users including, but not limited to, police, military, campers or backpackers, and athletes, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A portable container, comprising:

a bag defined by a back, bottom, and side panels, wherein said panels define a compartment having an open front;

a cover having a first end removably attached to connection points at a bottom of said back panel or a back of said bottom panel and a second end removably attached to connection points at a top of said back panel, wherein said cover removably covers said open front of the said compartment;

at least one shoulder strap;

pockets attached to various ones of said panels;

and at least one connection point.

2. The portable container of claim 1, where said at least one should strap is two shoulder straps.

3. The container of claim 1, wherein said bag is configured to be operable as a backpack.

4. The container of claim 3, wherein said at least one connection point is configured as an attachment means comprising at least one of a D ring, a carabiner, a loop, a hook and a clip configured for attachment to at least one external surface of said bag.

5. The container of claim 4, wherein said at least one connection point is configured for attachment of items not held inside said bag.

6. The container of claim 1, wherein said bottom panel is configured in an angled positon to prevent items from falling out of said bag.

7. The container of claim 1, wherein said bag is configured to contain firefighting gear.

8. The container of claim 1, wherein said bag is made out of materials comprising at least one of nylon, polypro, cotton, PVC, polyester, and Cordura.

9. The container of claim 1, wherein said cover is configured to maintain contents of said bag in place.

10. The container of claim 1, wherein frames are disposed at outer edges of said panels and configured to maintain shape of said bag.

11. The container of claim 1, wherein said pockets are configured to contain at least gloves and other firefighting supplies.

* * * * *